US006640709B1

(12) United States Patent
Lowrance

(10) Patent No.: US 6,640,709 B1
(45) Date of Patent: Nov. 4, 2003

(54) INK PAD HAVING LAYER OF COMPRESSED NON-WOVEN POLYPROPYLENE FILAMENT AND METHOD OF MAKING

(76) Inventor: Bobby Kenneth Lowrance, 2725 E. Douglas, Wichita, KS (US) 67211

( * ) Notice: Subject to any disclaimer, the term of this patent is extended or adjusted under 35 U.S.C. 154(b) by 0 days.

(21) Appl. No.: 10/173,517

(22) Filed: Jun. 18, 2002

(51) Int. Cl.[7] ..... B41K 1/50; B41K 1/54

(52) U.S. Cl. ..... 101/333; 101/327

(58) Field of Search ..... 101/327, 333, 101/335; 118/264; 428/321.3; 442/320, 268

(56) References Cited

U.S. PATENT DOCUMENTS

| | | | | | |
|---|---|---|---|---|---|
| 3,641,934 | A | * | 2/1972 | Rudolf | 101/333 |
| 5,049,432 | A | * | 9/1991 | Ooms et al. | 428/159 |
| 5,124,200 | A | * | 6/1992 | Mallonee | 428/131 |
| 5,611,279 | A | * | 3/1997 | Ando et al. | 101/401.1 |
| 6,000,335 | A | * | 12/1999 | Imamaki et al. | 101/327 |

* cited by examiner

*Primary Examiner*—Leslie J. Evanisko
(74) *Attorney, Agent, or Firm*—Edward L. Brown, Jr.

(57) ABSTRACT

A substantially rigid ink pad assembly made of a first layer of a non-woven polypropylene filament bonded in an adhesive which is compressed and heated to a rigid form. The first layer is then thermally bonded to a thin layer of suede-like fabric which layered ink pad is contained in an open top tray.

10 Claims, 1 Drawing Sheet

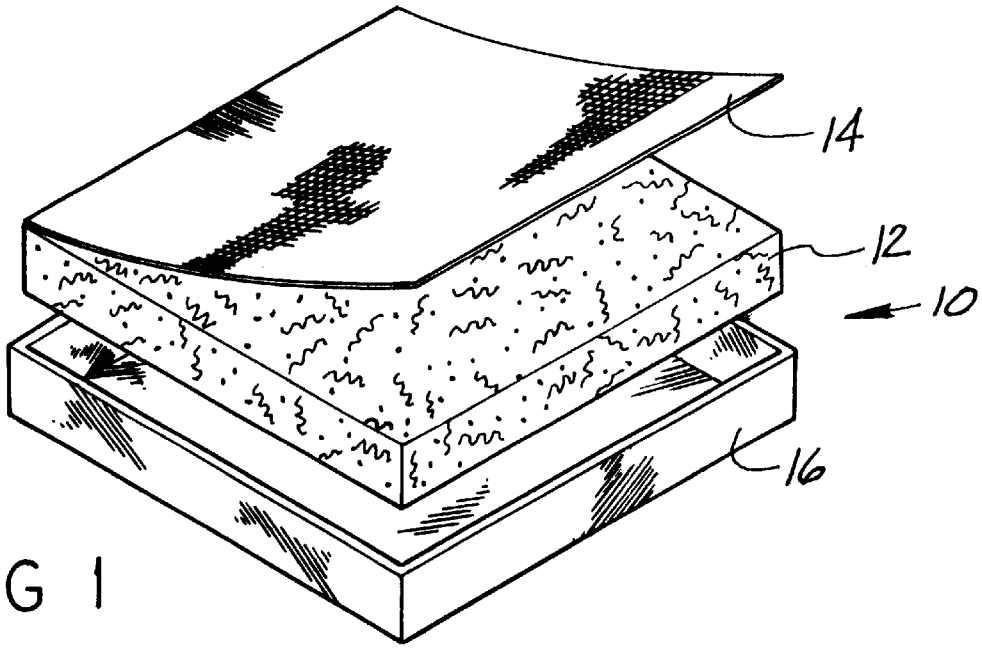
FIG 1
FIG 2
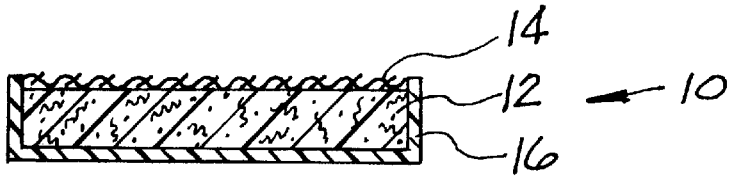
FIG 3
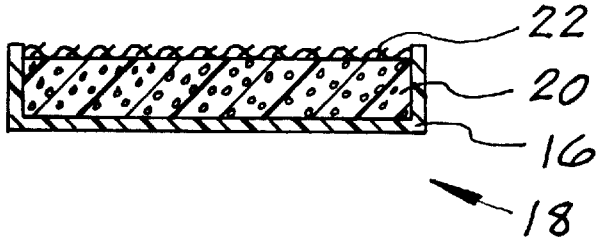
PRIOR ART
FIG 4
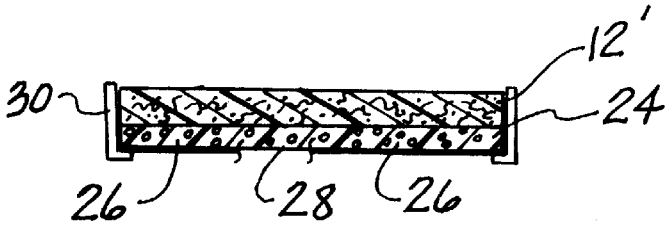

INK PAD HAVING LAYER OF COMPRESSED NON-WOVEN POLYPROPYLENE FILAMENT AND METHOD OF MAKING

BACKGROUND OF THE INVENTION

The present invention relates to ink pads for use in self-inking rubber stamps and pre-inked stamps both of which are well known in the art. The prior art originally taught an ink stamp pad separate from a rubber stamp to ink the stamp. These conventional ink pads varied in size and were typically contained in plastic or metal containers with a closure lid to prevent the ink from drying out when the pad was not in use. Those pads, generally referred to as conventional ink pads, were usually formed of cotton felt and then enclosed with a thin fabric of cotton or linen.

The technology of rubber stamps moved on to self-inkers, such as date stamps, where the ink pad was contained within the stamp, and the rubber stamp was held against the ink pad until the stamp was used whereupon the rubber stamp through a cam follower would rotate 180 degrees to a downward direction into engagement with the medium being stamped. The ink pads of these self-inkers are contained in an open topped tray and the pad is composed of a foam material having an open cell micropore structure which contains and holds the ink. Attached to the top surface of the foam pad is a thin layer of suede-like fabric which provides the necessary uniform ink transfer from the foam pad to the rubber stamp. Foam ink pads can only be used with water-based inks since oil and alcohol based inks will cause the pad to swell and render it unusable. For that reason, foam-type ink pads cannot be used with fast drying inks which are alcohol based.

When the self-inkers are not in use, the rubber stamp is held against the pad with a spring force which deforms the soft foam pad to the point the inkpad takes an impression of the stamp. This fixed impression also causes the edges of the ink pad to curl upward above the top edge of the tray and create problems when the tray is removed or inserted into the stamp.

Pre-inked stamps which are another modern concept include a layer of material (EVA) which is flashed with light with the image of the rubber stamp blocking the light so that the image of the stamp on the EVA material is open to pass ink onto the medium being stamped. The portion of the EVA material which light contacts causes the material to seal so the ink cannot pass through while the portion blocked from light by the stamp image freely passes ink to the medium being stamped. This pre-inked stamp process eliminates the step of inking the rubber stamp before the image is stamped on the medium. The ink cartridges of these pre-inked stamps utilize a proprietary foam material.

SUMMARY OF THE PRESENT INVENTION

The ink pad of the present invention is formed from a non-woven polypropylene filament which is compressed and heated to a substantially rigid form. The ink pad can be used with all types of inks since alcohol and oil based inks do not effect the polypropylene filament. Attached to the ink pad is a second layer of suede-like cloth which is bonded by a thermoplastic adhesive to form a unitary structure. The two-layer ink pad is contained within an open top tray as are the foam pads in the prior art and the trays fixedly position the pad within the overall stamp frame structure.

The tightly woven suede-like material has a relatively short nap and provides a good even ink transfer to the rubber stamp. Since the overall ink pad is relatively rigid, there are no problems with the edges of the pad turning up as with the foam pads. The compressed non-woven polypropylene filament absorbs as much ink as the form pads of the prior art and releases the ink in an acceptable manner when the stamp is put in use. The pads are made in large sheets that are readily cut to size by knife edges in an automated process well known in the prior art. The pad of the present invention can also be used as a conventional ink stamp pad for rubber stamps as mentioned above.

It is therefore the principal object of the present invention to provide an ink pad for conventional stamp pads, self-inkers, and pre-inked stamps which is relatively inexpensive to construct.

Another object of the present invention is to provide an ink pad which can be used with water, oil and alcohol based inks.

A further object of the present invention is to provide an ink pad which is substantially rigid while containing ample amounts of ink with superior ink release characteristics.

BRIEF DESCRIPTION OF THE DRAWINGS

FIG. 1 is an isometric exploded view of the ink pad of the present invention in a self-inking stamp including its container tray;

FIG. 2 is a sectional view of the pad of the present invention illustrating the first and second layers;

FIG. 3 is a cross-section of the prior art pad; and

FIG. 4 is a cross-section of the ink pad of the present invention in a pre-inked stamp.

DETAILED DESCRIPTION OF THE PREFERRED EMBODIMENT

The ink pad of the present invention, generally described by reference numeral 10, includes a first felted layer of non-woven polypropylene filament 12. The felted first layer 12 is essentially outdoor carpet which has a degree of resiliency before it is vulcanized. The second layer 14 of the pad 10 comprises a tightly woven thin suede-like fabric having a short nap such as a woven cotton cloth. The first and second layers are compressed together under heat and pressure to achieve a reduction in thickness in a range between 5 and 20 percent, preferably to approximately a 10 percent reduction in thickness and a substantially rigid consistency. This vulcanization process takes place at a temperature range between 200 and 400° Fahrenheit, preferably between 250 and 300° Fahrenheit, and most preferably at 290 degrees Fahrenheit for between 3 and 8 minutes and preferably for five minutes with a compression pressure of approximately 4000 psi. The resulting pad is relatively rigid compared with the outdoor carpet in its previous form. The second layer of suede-like fabric 14 is thermally bonded to the pad 12 comprising a large sheet. A series of knives, well known in the art, cut the large pad into the finished ink pad sizes as required in the stamps. Each of the pads 10 is contained in an opened top plastic tray 16. "Rapid Mark" brand ink produced by Superior Rubber Stamp & Seal, Inc., is a fast drying ink used for non-porous surfaces and can be used with the ink pad of the present invention while foam pads cannot.

The prior art ink pad 18, as shown in FIG. 3, utilizes an open cell foam material 20 as an ink reservoir and a similar second layer of suede-like material 22. This pad 18 can only be used with water-based inks.

An example illustrative of the method of manufacture of the composite ink pad of the present invention is set forth as follows:

The first layer is a Prestige brand of outdoor carpet manufactured by Bretlin, Inc., having a 0.200-inch thickness. The non-woven polypropylene filament has a latex unitary backing. The second layer of suede-like fabric is a Superior Micro fiber brand made by Fifield, Inc., and the first and second layers are thermally bonded by a Stitch Witchery brand of thermal adhesive. The vulcanizing process applies pressure of 4000 psi and heat of 290° F. for approximately five minutes and achieves a thickness reduction of 10%.

FIG. 4 illustrates the pad 12' of the present invention in a pre-inked stamp. The EVA material layer 24, which is proprietary with the Sunlux Corporation of Osaka, Japan, is porous and absorbs and holds ink from pad 12'. The bottom surface 26 of layer 24 is flashed with light causing the exposed portion to seal and block the passage of ink. The unexposed portion 28, which is the image of the stamp, passes ink to the medium receiving the stamp. A retention frame 30 holds the pad 12' and stamp layer 24 in contacting relation. The advantage of pad 12' over the foam pad normally used with the EVA material layer is that pad 12' distributes the ink better and the surface tension of the ink between the pad layer 12' and the EVA layer 24 prevents the stamp from drooping when the stamp is 3×3 inches or larger.

It is to be understood that the present disclosure relates to the preferred embodiment of the invention which is for purposes of illustration only, and not to be construed as a limitation of the invention. All such other uses, which do not depart from the spirit of the invention, are intended to be included within the scope of the dependent claims.

What is claimed is:

1. An ink pad assembly for use in a self-inking rubber stamp comprising:

an ink pad including:

a pad having a felted first layer of non-woven polypropylene filament bonded by a thermoplastic adhesive which is compressed under heat and pressure to achieve a reduction in thickness in a range between 5 and 20 percent and a substantially rigid consistency; and a second layer of thin suede-like fabric which is bonded to the first layer; and a tray which contains and surrounds the ink pad.

2. An ink pad assembly, as set forth in claim 1, wherein the first layer is compressed under a pressure range between 3000 and 5000 PSI and a temperature range between 250 and 300° Fahrenheit.

3. An ink pad assembly, as set forth in claim 1, wherein the first layer is outdoor carpet.

4. An ink pad assembly, as set forth in claim 1, wherein the first layer is compressed under heat for a range of between 3 and 8 minutes.

5. An ink pad assembly, as set forth in claim 1, wherein the reduction is substantially 10 percent.

6. An ink pad assembly, as set forth in claim 1, wherein the second layer is a woven cotton cloth.

7. A method of making an ink pad for a stamp comprising the following steps:

placing a layer of resilient outdoor carpet having an original thickness in a press;

applying heat to the layer in a range between 200° Fahrenheit and 400° Fahrenheit for three to eight minutes; and applying pressure to the layer to compress the same to approximately 10% of said original thickness.

8. A method, as set forth in claim 7, wherein the steps of applying pressure and heat take place at the same time.

9. A method of making an ink pad as set forth in claim 7 wherein the pressure range is between the numbers 3000 psi and 5000 psi and the temperature range is between 250° F. and 300° F.

10. An ink pad for use in a pre-inked stamp having a stamp layer comprising:

a pad adapted to be positioned above the stamp layer, said pad having a felted layer of non-woven polypropylene filament bonded by an adhesive which is compressed under heat and pressure to achieve a reduction in thickness and a substantially rigid consistency; and a retention frame adapted to hold the pad and stamp layer in juxtaposed contacting relation.

* * * * *